United States Patent [19]

Golobay et al.

[11] 4,037,704

[45] July 26, 1977

[54] ACTUATOR FOR A WIRE MATRIX PRINTER AND METHOD OF MAKING

[75] Inventors: Gary L. Golobay, Valley Center; Robert L. Schrag, Wichita, both of Kans.

[73] Assignee: NCR Corporation, Dayton, Ohio

[21] Appl. No.: 593,082

[22] Filed: July 3, 1975

[51] Int. Cl.[2] ..... B41J 3/04

[52] U.S. Cl. ..... 197/1 R; 101/93.33; 335/274

[58] Field of Search ..... 197/1 R; 335/251, 255, 335/257, 258, 274; 101/93.04, 93.05, 93.32–93.34

[56] References Cited

U.S. PATENT DOCUMENTS

| | | | |
|---|---|---|---|
| 3,672,482 | 6/1972 | Brumbaugh et al. | 197/1 R |
| 3,690,431 | 9/1972 | Howard | 197/1 R |
| 3,787,791 | 1/1974 | Borger et al. | 335/274 |
| 3,804,009 | 4/1974 | Blume | 101/93.33 |
| 3,831,729 | 8/1974 | Howard | 197/1 R |
| 3,842,734 | 10/1974 | Gomi | 101/93.34 |
| 3,850,278 | 11/1974 | Mihm et al. | 197/1 R |
| 3,940,726 | 2/1976 | Gershnow | 335/274 |

*Primary Examiner*—Ralph T. Rader
*Attorney, Agent, or Firm*—J. T. Cavender; Albert L. Sessler, Jr.; Elmer Wargo

[57] ABSTRACT

An actuator for a wire matrix printer including a plunger which is mounted in a frame for reciprocal movement between first and second positions therein, and the plunger has a print wire fixed thereto by a special swaging technique. The plunger is moved to and held in the first position against the bias of a special spring by a permanent magnet. When the actuator is to be fired, a neutralizing coil is energized to nullify the holding effect of the magnet, enabling the spring to accelerate the plunger towards the second position (towards a platen). The spring is disconnected from the plunger after it is accelerated, enabling the plunger and print wire attached thereto to travel ballistically at least part of the way to the second position from the first position.

6 Claims, 10 Drawing Figures

ACTUATOR FOR A WIRE MATRIX PRINTER AND METHOD OF MAKING

BACKGROUND OF THE INVENTION

This invention relates to an actuator for a wire matrix printer and to a method for securing a print wire to a plunger means used in the actuator.

The actuator of this invention may be used in a high speed wire matrix printer of the types shown in U.S. Pat. Nos 3,795,298, and 3,833,105, for example. The printers described therein are capable of forming characters by selectively impacting one or more of seven print wires (arranged in a vertical column near the associated platen) against an inking ribbon so as to print "dots" upon the surface of a record medium located behind the ribbon and held on the platen of the associated printer. A plurality of the columns printed are related so as to form any character or symbol, typically within a five by seven matrix or a seven by nine matrix.

Some other prior art actuators for wire matrix printers are shown in the following U.S. Pat. Nos.: 3,592,311, 3,792,079, 3,770,092, 3,787,791, 3,831,729, and 3,835,975.

None of the prior art references cited shows a plunger-type actuator for a wire matrix printer which utilizes a magnet means for biasing the plunger means to a first or a ready position against the bias of a spring means, and a neutralizing coil for neutralizing the holding effect of the magnet means enabling the plunger means to travel ballistically at least part way towards a second or impact position. Neither the specific construction of the spring means nor the specific method of attaching a print wire to the associated plunger means is shown in said references.

SUMMARY OF THE INVENTION

The actuator of this invention comprises a frame means with a plunger means mounted in the frame means for reciprocal movement between first and second positions therein. A print wire is fixed to the plunger means to travel therewith. A spring means is operatively connected to the plunger means to be tensioned or biased as the plunger means is moved to the first position by a magnet means which attracts the plunger means to the first position and holds it there against the tension of the spring means. When the actuator is to be fired, a coil means is energized, and it neutralizes the holding effect of the magnet means, permitting the spring means to accelerate the plunger means towards the second position. The spring means is operatively disconnected from the plunger means after accelerating the plunger means towards the second position to enable the plunger means to travel ballistically at least part way towards said second position.

The present invention provides an actuator having a long stroke and a high print energy, with each actuator delivering from about 13,000 to 15,000 ergs of print energy against a record medium during printing. A print head made up of the actuators of the present invention will print about 90 characters per second at a 0.035 inch stroke of the associated print wires, and with a shorter stroke of 0.015 inch, the print head will produce 130 characters per second.

The method of joining the print wire to its associated plunger is especially suitable for mass production.

The fact that the plunger means of the actuator of the present invention travels ballistically for at least part of the way towards a record medium provides for long, constant-energy, print wire strokes. The actuator's long stroke enables printing on record forms of varying thicknesses. A print head made up of actuators of the present invention is able to print on six to eight copies when using standard carbon paper, and when using carbonless paper, eight easily readable copies are obtained.

These advantages of this invention along with others will be more readily understood upon reading the following description and drawings.

DETAILED DESCRIPTION OF THE INVENTION

Figure 1:
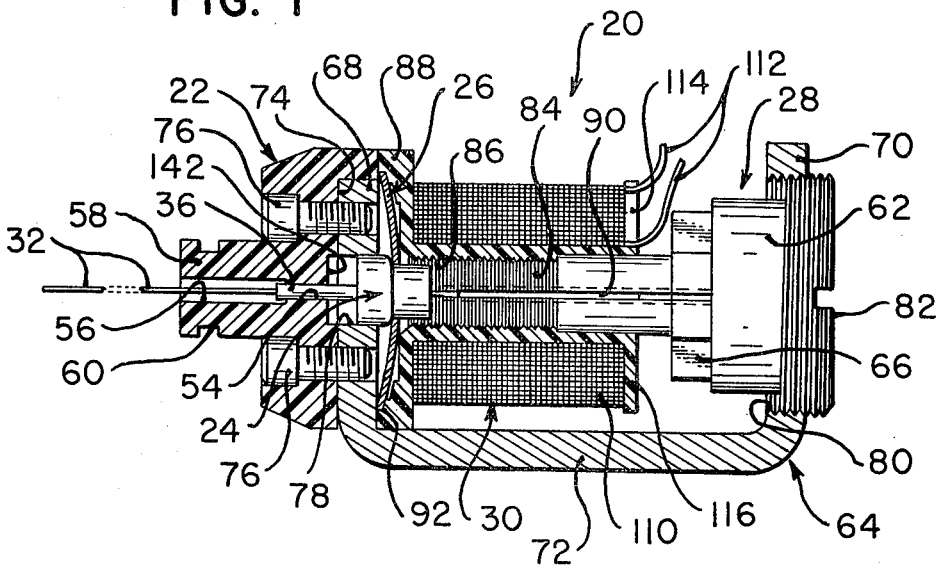
FIG. 1 is a side, elevational view, in cross section, of an actuator for a wire matrix printer embodying the principles of this invention, and showing a frame means, plunger means, spring means, magnet means and coil means.
Figure 2:
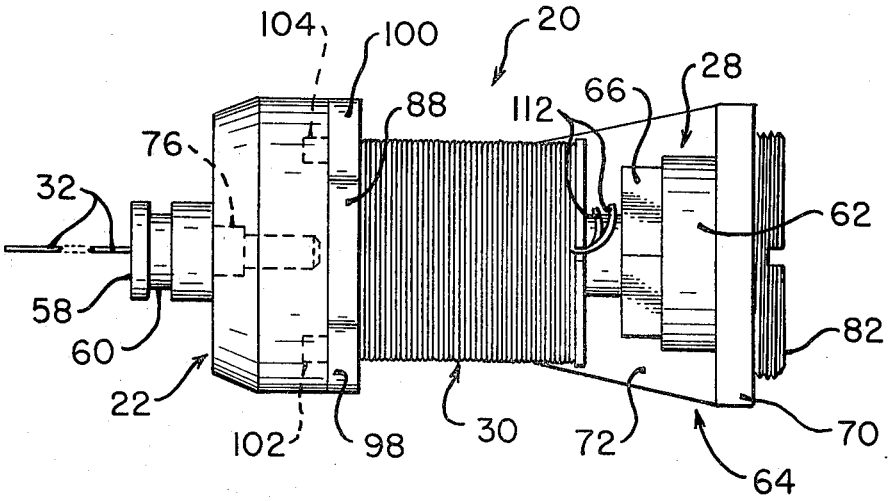
FIG. 2 is a plan view of the top of the actuator shown in FIG. 1.
Figure 3:
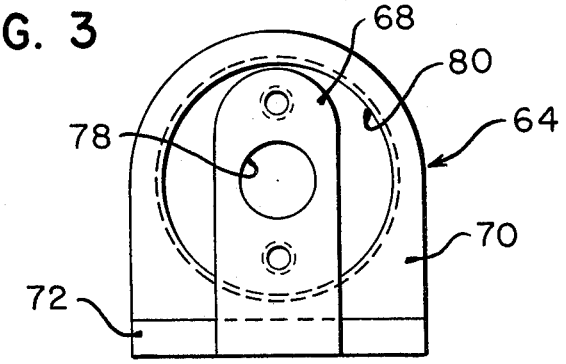
FIG. 3 is a front elevational view, as seen from the left side of FIG. 1 showing a collector means of the magnet means.

The actuator designated generally as 20 in FIGS. 1 and 2 is comprised of a frame means 22, a plunger means 24, a spring means 26, a magnet means 28, and a coil means 30.

The plunger means 24 is mounted in the frame means 22 for a reciprocal movement between first and second positions therein. The magnet means 28 pulls and holds the plunger means 24 in the first position shown in FIG. 1, against the tension of the spring means 26 which is operatively connected to the plunger means 24. When the actuator 20 is to be fired, the coil means 30 is energized, producing a neutralizing effect on the magnet means 28, permitting the tensioned or biased spring means 26 to accelerate the plunger means 24 towards the second position (to the left as viewed in FIG. 1). After accelerating the plunger means 24 towards the second position, the spring means 26 is disconnected from the plunger means 24, permitting it to travel ballistically at least part of the way towards the second position where a print wire 32, fixedly secured to the plunger means 24, impacts against a ribbon and record medium (not shown) in known manner.

Figure 6:
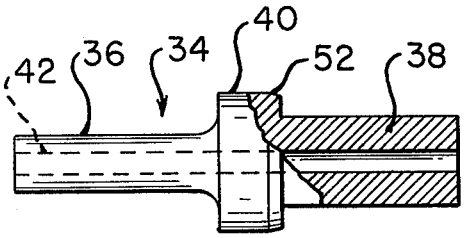
FIG. 6 is a side view in elevation of a bearing which is part of the plunger means.

The plunger means 24 is comprised in part of a generally cylindrical member 34 made of a soft bearing material like brass and shown in a greatly enlarged view in FIG. 6. The member 34 has a first cylindrical end 36 and a second cylindrical end 38 which are joined by a cylindrical section 40. The member 34 has a longitudinally aligned hole 42 therein whose longitudinal axis is coincident with the longitudinal axis of cylindrical ends 36 and 38. The print wire 32 is inserted through the cylindrical member 34 to extend out of both ends of the plunger means 24 as shown in FIG. 1.

Figure 8:
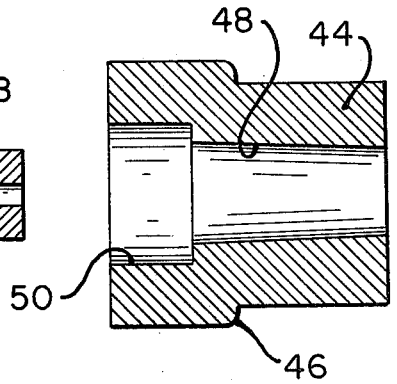
FIG. 8 is a cross-sectional view of a plunger which is part of the plunger means shown in FIG. 1.

The plunger means 24 also includes a ferrous, cylindrically-shaped, tubular member 44 (FIG. 8) which has an annular shoulder 46 around the periphery thereof. The member 44 is made of 2½% silicon steel and has a tapered hole 48 therein which communicates with an annular recess or a larger hole 50. The longitudinal axis of the holes 48 and 50 is coincident with the longitudinal axis of cylindrical member 34 when assembled therewith as shown in FIG. 1. The hole 48 is tapered at an angle $\alpha$, which is the embodiment shown is 3.0°, with the wider diameter of the hole 48 being adjacent to hole 50. The cylindrical member 34 and tubular member 44 are dimensioned to provide an interference fit when assembled as shown in FIG. 1. For example, in one embodiment of the invention, the outer diameter of the second end 38 is $$.066 \begin{smallmatrix} + .0005 \\ - .0000 \end{smallmatrix} \text{ inch}$$

and the inner diameter of the tapered hole 48 in tubular member 44 at the narrow end thereof is 0.062 ±0.0005 inch, and the total length of the cylindrical member 34 is 0.330 inch.

The method of attaching the print wire 32 to the plunger means 24 is novel and an important feature of this invention. Most of the previous known techniques attach the print wire to the associated plunger by a brazing technique or by an external swage. Brazing is not desirable because it is not easily adaptable to high volume production methods, and usually, the heat which is applied during brazing changes the characteristics of the plunger and print wire, especially when the print wire is made of tungsten, as it often is. As external swage can be used to attach the print wire to the plunger, but due to the induced stresses being partially relieved after the swaging operation is completed, the joining forces between the print wire and the plunger are not high, leaving a weak connection between the two. Some external swaging techniques also leave nicks or impressions on the plunger; this is not good from a stress concentration point, and the nicks or impressions also disrupt or restrict magnetic paths passing therethrough.

The swaging method employed in this invention for joining the print wire 32 to the plunger means 24 avoids all the problems cited in the previous paragraph. The print wire 32 which is made of tungsten and has a diameter of 0.015 inch is first inserted in the hole 42 in the cylindrical member 34, which hole has a diameter of $$.016 \begin{smallmatrix} + .001 \\ - .000 \end{smallmatrix} \text{ inch}$$

in the embodiment shown. The print wire 32 also extends out of the second end 38 for a purpose to be later described. The cylindrical member 34 with the print wire 32 therein is then aligned with the tapered hole 48 in the tubular member 44. The members 34 and 48 are then placed in a conventional press (not shown) and the tubular member 44 is forced down over the second end 38 of the cylindrical member 34 until the cylindrical section 40 is press fitted into the hole 50 in the tubular member 44. The outer diameter of the section 40 is $$.101 \begin{smallmatrix} + .0005 \\ - .0000 \end{smallmatrix} \text{ inch}$$

and the inner diameter of hole 50 is $$.100 \begin{smallmatrix} + .0000 \\ - .0005 \end{smallmatrix} \text{ inch}$$

in the embodiment shown; however, the section 40 has a chamfer 52 thereon to facilitate the engagement of the parts. During the interfitting, the second cylindrical end 38 interferes with the sides of the tapered hole 48, and the cylindrical end 38 is forced to flow to conform to the tapered hole 48. In this way, the walls of the tubular member 44 are slightly strained and very high stresses are induced in cylindrical member 34 and the tubular member 44. This action wedges the print wire 32 in the brass cylindrical member 34, and wedges the member 34 within the steel tubular member 44. The induced stresses cannot relieve themselves, and a very rigid union is maintained between the print wire 32 and the plunger means 24.

Figure 4:
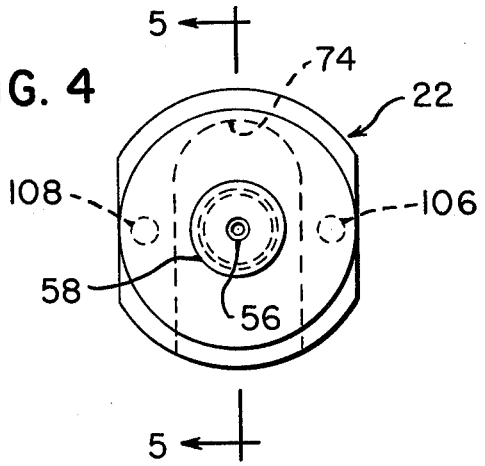
FIG. 4 is a front elevational view, as seen from the left side of FIG. 1 showing additional details of the frame means.
Figure 5:
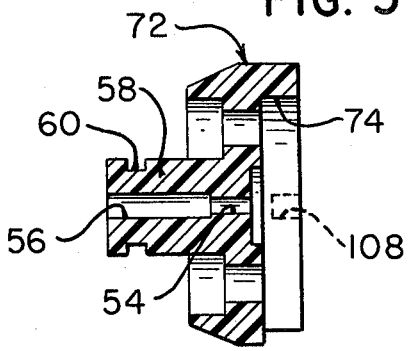
FIG. 5 is a cross-sectional view, taken along the line of 5—5 of FIG. 4.
Figure 7:
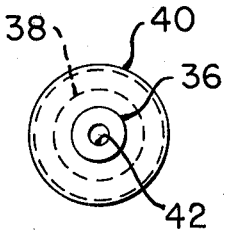
FIG. 7 is an end view of the bearing shown in FIG. 6.

The first cylindrical end 36 of the plunger means 24 (FIG. 1) acts as a bearing for mounting the plunger means 24 for reciprocal movement in the frame means 22; this is accomplished by slidably mounting the first cylindrical end 36 in a hole 54 in the frame means 22 which, in the embodiment shown, is made of a tough plastic material like acetal resin which is sold under the trademark "Delrin" and is manufactured by DuPont of Wilmington, Del., and has the general shape shown in FIGS. 1, 4 and 5. The frame means 22 has second hole 56 larger in diameter than hole 54 and concentric therewith to minimize the bearing friction of the cylindrical end 36 in the frame means 22. The frame means 22 has a cylindrical end 58 having suitable means thereon like an annular recess 60 or an external thread thereon (not shown) for securing each actuator 20 to a frame to form a print head as is shown in U.S. Pat. No. 3,802,543, for example.

The magnet means 28 (FIG. 1) alluded to earlier is secured to the frame means 22 in the following manner. The magnet means 28 includes a permanent magnet 62, a collector means 64, and a core mean 66. The collector means 64 is made of ferrous material and is a generally U-shaped member having a first leg 68 and a second leg 70 spaced apart in parallel relationship and joined by a connecting portion 72. The first leg 68 fits into a complementary recess 74 of the frame means 22 and is detachably secured thereto by fasteners 76. The first leg 68 has a hole 78 therein to permit the plunger means 24 to be reciprocated therethrough without touching the first leg 68. The second leg 70 has a large threaded hole 80 therein to receive a flat screw 82 used for securing the magnet 62 in place. The magnet 62 is made of rare earth materials like samarium-cobalt which have a very high energy product, and it is formed into a small cylinder or button as shown. The magnet 62 is sandwiched between the flat screw 82 and the core means 66 which is similar in appearance to a cap screw and made of ferrous material, preferably silicon iron which has a high electrical resistivity, and therefore, is subject to smaller eddy current levels. The core means 66 has a threaded end 84 which is mated with a threaded hole 86 in a bobbin 88 of the coil means 30 to adjustably position the core means 66 within the coil means 30. The core means 66 also has a slot 90 therein located along the length thereof, and the slot reaches a depth close to the longitudinal axis thereof to reduce eddy currents flowing therein.

Figure 9:
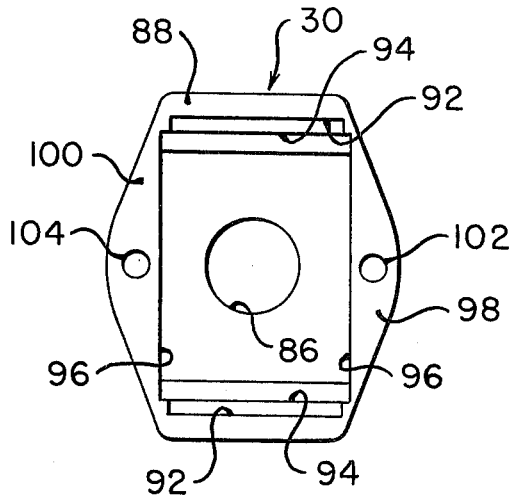
FIG. 9 is a front view, as viewed from the left side of FIG. 1, of a bobbin of the coil means.

The bobbin 88 is made of plastic and has the general shape shown in FIGS. 1, 2, and 9. As seen in FIG. 9, the side of bobbin 88 facing the first leg 68 of the collector means 64 has opposed rectangularly shaped recesses or steps 92 therein to receive the opposed sides of spring means 26. The bobbin 88 also has second, opposed rectangularly-shaped recesses or steps 94 to provide flexing room for the spring means 26. The bobbin 88 has opposed sides 96 which are wider than the spring means 26 to also enable the spring means 26 to flex without engaging the sides of the bobbin 88. The bobbin 88 has flanges 98 and 100 thereon with locating pins 102 and 104 respectively, upstanding therefrom, and the pins 102 and 104 are inserted into holes 106 and 108 respectively (FIG. 4) located in the frame means 22 to locate the bobbin 88 relative to the frame means 22 when in the assembled relationship shown in FIGS. 1 and 2. A coil 110, wound on the bobbin 88, has its ends 112 passing through a slot 114 in the flange 116 of the bobbin 88. In the embodiment shown, the coil 110 is comprised of 250 turns of No. 26 wire, and is conventionally wound to neutralize the effect of the magnet means 28 when the coil 110 is conventionally energized by a source of energizing current (not shown).

Figure 10:
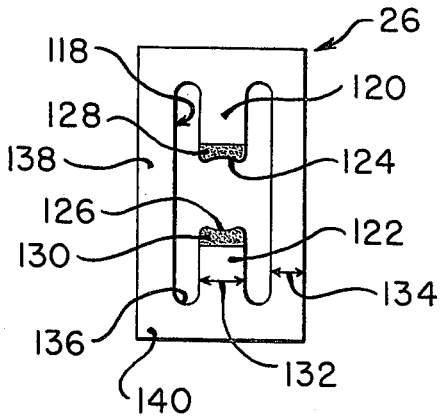
FIG. 10 is a plan view of the spring means shown in FIG. 1.

The spring means 26 shown in FIG. 1 has the general rectangular shape shown in FIG. 10. The spring means 26 in the embodiment shown is made of planar or sheet spring steel havng a thickness of 0.014 inch, an overall width of 0.350 inch, and a length of 0.625 inch. The spring means 26 has a cut out portion 118 generally in the shape of a letter H to produce the fingers 120 and 122 which depend from the opposed narrow sides of the spring means 26 towards the center thereof. The fingers 120 and 122 have arcuate recesses 124 and 126 respectively, formed therein, to operatively engage the annular shoulder 46 of the tubular member 44 on opposed sides thereon when in the assembled relationship shown in FIG. 1. Each of the fingers 120 and 122 has a layer of hard chrome thereon in the shaded areas 128 and 130, respectively, to provide a low-friction, hard-bearing surface to engage the shoulder 46 of the tubular member 44. In the embodiment shown, the width of the fingers 120 and 122 as measured by line 132 is .100 inch, and the width of the outer side walls as measured by line 134 is .075 inch. The spring means 26 also has curved sections as at 136, between the side walls (as at 138) and the end walls (as at 140), to distribute the stresses between the side and end walls and the fingers 120, 122.

The design of the spring means 26 is an important feature of this invention. When the spring means 26 is tensioned as shown in FIG. 1, most of the energy stored therein is stored in the side walls (138) and these side walls have a constant stress across their length due to the way in which the spring means 26 is supported ie., at the opposed end walls (140). In this way, maximum use of the material of the spring means 26 is gained without stress concentrations being located at particular areas thereof, thereby permitting the use of a smaller spring parts. Because only the tips of the fingers 120, 122 (at areas 128 and 130) contact the plunger means 24, it is primarily this small mass of the fingers 120, 122 (and the side walls 38 to some degree) of the spring means 26 which must be accelerated when accelerating the plunger means 24 towards the second position (or towards a platen). The side walls 138 of the spring means give a motion leverage to the fingers 120, 122 without being required to follow them.

The core means 66 of the magnet means 28 and the plunger means 24 (FIG. 1) are adjusted relative to each other in the following manner. With the coil 110 deenergized, the core means 66 is advanced in the bobbin 86 towards the plunger means 24 (with simultaneously advancement of the magnet 62 and screw 82) until the plunger means 24 "snaps in" or makes physical contact with the end of the core means 66, as shown in FIG. 1. As previously stated, the print wire 32 extends through the plunger means 24 and is slidably mounted in a mating hole located in the core means 66 along the longitudinal axis thereof. The holding force of the magnet means 28 is quite strong, and it tensions the spring means 26 to the position shown in FIG. 1. When the actuator 20 is to be fired, an energizing current is sent through the coil 110, producing a flux which neutralizes the holding effect of the magnet means 28, permitting the fingers 120, 122 of the spring means 26 to accelerate the plunger means 24 from the first position shown in FIG. 1 towards the second position (to the left). The fingers 120, 122 then abut against the first leg 68 of the collector means 64 operatively disconnecting the spring means 26 from the plunger means 24, permitting the plunger means 24 to travel ballistically to the second position where the associated print wire 32 impacts against the ribbon and record medium on the platen of a printer in which the actuator 20 is used. The frame means 22 has an annular recess 142 against which the plunger means 24 abuts as a limiting stop. After the plunger means 24 has been fired as described, the coil 110 is deenergized, permitting the magnet means 28 to attract and hold the plunger means 24 in contact with the core means 66 in a ready position for the next firing.

As an alternative method of operation, it is possible to adjust the plunger means 24 (FIG. 1) relative to the magnet means 28 so that the permanent magnet 62 thereof can no longer recapture the plunger means 24 by itself. Recapture of the plunger means 24 can be effected by "reverse driving" the coil 110 under the return of the plunger means 24 from the second to the first or ready position so that the energized coil 110 will augment the field of the magnet 62. This would enable more energy to be stored in the spring means 26 without redesigning the actuator 20.

What is claimed is:

1. An actuator for a wire matrix printer comprising:

a frame means;

a plunger means having opposed abutment areas thereon and being mounted in said frame means for reciprocal movement between first and second position therein, and a print wire fixed to said plunger means to travel therewith;

a spring means having opposed fingers operatively connected to said opposed abutment areas on said plunger means to bias said spring means when said plunger means is moved to said first position;

magnet means producing a magnetic effect for attracting said plunger means toward said first position and for holding it in said first position against the bias of said spring means, and also having abutment areas thereon;

means for producing a neutralizing flux which neutralizes said magnetic effect of said magnet means enabling said spring means to accelerate said plunger means towards said second position; and said spring means being operatively disconnected from said plunger means after accelerating said plunger means towards said second position by having said spring means engage said abutment areas on said magnet means to thereby enable said plunger means to travel ballistically at least part way towards said second position.

2. An actuator for a wire matrix printer comprising:

a frame means;

a plunger means mounted in said frame means for reciprocal movement between first and second positions therein, and a print wire fixed to said plunger means to travel therewith;

a spring means operatively connected to said plunger means to be biased when said plunger means is moved to said first position;

magnet means producing a magnetic effect for attracting said plunger means towards said first position and for holding it in said first position against the bias of said spring means;

means for producing a neutralizing flux which neutralizes said magnetic effect of said magnet means enabling said spring means to accelerate said plunger means towards said second position; and said spring means being operatively disconnected from said plunger means after accelerating said plunger means towards said second position to enable said plunger means to travel ballistically at least part way towards said second position;

said plunger means having generally cylindrically shaped and having opposed abutment areas thereon;

said spring means being formed of a resilient metallic sheet and being generally planar having a portion cut out generally in the shape of a letter H to produce opposed fingers which engage said opposed abutment areas;

said plunger means also having a tubular bearing through which said print wire passes;

said frame means having an end cap with a longitudinal hole therein to slidably receive said tubular bearing to enable said plunger means to be reciprocated between said first and second positions;

said magnet means including a permanent magnet, a collector means and a core means to complete a magnetic path to said plunger means;

said plunger means being held against said core means when in said first position;

said means for producing a neutralizing flux incuding a bobbin and a coil wound thereon;

said bobbin having a longiudinal axis which is coincident with the longitudinal axis of said print wire, and also having a recessed area in one end thereof for receiving said spring means when biased;

said collector means having abutment areas thereon to operatively disconnect said opposed fingers from said plunger means to enable said plunger means to travel ballistically towards said second position.

3. The actuator as claimed in claim 2 in which said collector means is generally U-shaped having first and second spaced parallel legs joined by a connecting portion;

said first leg having an opening therein through which said plunger means reciprocates;

said core means having a longitudinal axis coincident with the longitudinal axis of said print wire;

said bobbin having an opening in which said core means is mounted;

said permanent magnet being located between said core means and said second leg of said collector means.

4. The actuator as claimed in claim 3 in which said core means has means thereon for adjustably mounting said core means in said bobbin and in which said permanent magnet is of the button type and is made of samarium-cobalt, and in which said core means has a hole therein whose longitudinal axis is coincident with the longitudinal axis of said print wire;

said print wire having first and second ends extending from opposed sides of said plunger means with said first end being slidably supported in the hole of said core means and said second end of said print wire being shaped to impact against a platen.

5. An actuator for a wire matrix printer comprising:

a frame means;

a plunger means in said frame means for reciprocal movement between first and second positions therein, and a print wire fixed to said plunger means to travel therewith;

a spring means operatively connected to said plunger means to be biased when said plunger means is moved to said first position;

magnet means producing a magnetic effect for attracting said plunger means toward said first position and for holding it in said first position against the bias of said spring means;

means for producing a neutralizing flux which neutralizes said magnetic effect of said magnet means enabling said spring means to accelerate said plunger means towards said second position; and said spring means being operatively disconnected from said plunger means after accelerating said plunger means towards said second position to enable said plunger means to travel ballistically at least part way towards said second position;

said plunger means being generally cylindrically shaped having opposed abutment areas thereon;

said spring means having opposed fingers to engage said abutment areas;

said spring means being formed of planar, resilient, spring steel and being rectangular in shape having a thickness of about 0.014 inch thick;

said spring means having a portion cut out generally in the shape of a letter H leaving a peripheral wall around the perimeter of said spring means, with said fingers depending towards the center of said spring means from opposed sides of said peripheral wall, said fingers having inner ends being arcuately shaped to engage said abutment areas of said plunger means.

6. An actuator for a wire matrix printer comprising:

a frame means;

a plunger means mounted in said frame means for reciprocal movement between first and second positions therein, and a print wire fixed to said plunger means to travel therewith;

a spring means operatively connected to said plunger means to be biased when said plunger means is moved to said first position;

magnet means producing a magnetic effect for attracting said plunger means towards said first position and for holding it in said first position against the bias of said spring means;

means for producing a neutralizing flux which neutralizes said magnetic effect of said magnet means enabling said spring means to accelerate said plunger means towards said second position; and said spring means being operatively disconnected from said plunger means after accelerating said plunger means towards said second position to enable said plunger means to travel ballistically at least part way towards said second position;

said plunger means being generally cylindrically shaped having opposed abutment areas thereon;

said spring means having opposed fingers to engage said abutment areas;

said plunger means comprising:

a ferrous tubular member having an annular shoulder thereon to produce said abutment areas and having a tapered hole along its longitudinal axis;

a generally cylindrical member made of a material softer than said ferrous tubular member and having a hole along its longitudinal axis to receive said print wire therein and having first and second ends;

said first end being slidably mounted in said frame means and said second end being dimensioned to form an interference fit with the tapered hole of said ferrous tubular member;

said ferrous tubular member having internal stresses therein when said second end is mounted in said tapered hole so as to rigidly retain said print wire in said cylindrical member.

* * * * *

UNITED STATES PATENT OFFICE

CERTIFICATE OF CORRECTION

Patent No. 4,037,704 Dated July 26, 1977

Inventor(s) Gary L. Golobay and Robert L. Schrag

It is certified that error appears in the above-identified patent and that said Letters Patent are hereby corrected as shown below:

Column 8, line 18, after "means" (first occurrence) insert --mounted--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*